US008612218B2

(12) United States Patent
Vary et al.

(10) Patent No.: US 8,612,218 B2
(45) Date of Patent: Dec. 17, 2013

(54) METHOD FOR ERROR CONCEALMENT IN THE TRANSMISSION OF SPEECH DATA WITH ERRORS

(75) Inventors: Peter Vary, Aachen (DE); Frank Mertz, Aachen (DE)

(73) Assignee: Robert Bosch GmbH, Stuttgart (DE)

( * ) Notice: Subject to any disclaimer, the term of this patent is extended or adjusted under 35 U.S.C. 154(b) by 280 days.

(21) Appl. No.: 13/121,820

(22) PCT Filed: Sep. 28, 2009

(86) PCT No.: PCT/EP2009/062527

§ 371 (c)(1),
(2), (4) Date: May 26, 2011

(87) PCT Pub. No.: WO2010/037713

PCT Pub. Date: Apr. 8, 2010

(65) Prior Publication Data

US 2011/0218801 A1 Sep. 8, 2011

(30) Foreign Application Priority Data

Oct. 2, 2008 (DE) ..... 10 2008 042 579

(51) Int. Cl.
*G10L 21/02* (2013.01)
*G10L 21/00* (2013.01)

(52) U.S. Cl.
USPC ..... 704/228; 704/225

(58) Field of Classification Search
None
See application file for complete search history.

(56) References Cited

U.S. PATENT DOCUMENTS 4,589,131 A * 5/1986 Horvath et al. ..... 704/214
5,909,663 A * 6/1999 Iijima et al. ..... 704/226
5,953,697 A * 9/1999 Lin et al. ..... 704/225
7,411,985 B2 8/2008 Lee et al.
7,590,531 B2 9/2009 Khalil et al.
7,693,710 B2 * 4/2010 Jelinek et al. ..... 704/207
7,930,176 B2 * 4/2011 Chen ..... 704/228
8,121,835 B2 * 2/2012 Archibald ..... 704/225
8,255,207 B2 * 8/2012 Vaillancourt et al. ..... 704/219
2004/0184443 A1 9/2004 Lee et al.
2006/0271359 A1 11/2006 Khalil et al.

FOREIGN PATENT DOCUMENTS

JP 9281996 10/1997
JP 2001022367 1/2001

OTHER PUBLICATIONS

J. Paulus, Codierung breitbandiger Sprachsignale bei niedriger Datenrate. Dissertation, IND, RWTH Aachen, Templergraben 55, 52056 Aachen, 1997.

P. Vary, U. Heute, W. Hess, Digitale Sprachsignalverarbeitung, B.G. Teubner Verlag, Stuttgart, 1998, ISBN 3-519-06165-1.

PCT/EP2009/062527 International Search Report.

(Continued)

*Primary Examiner* — Brian Albertalli

(74) *Attorney, Agent, or Firm* — Michael Best & Friedrich LLP

(57) ABSTRACT

The invention relates to a method for outputting a speech signal. Speech signal frames are received and are used in a predetermined sequence in order to produce a speech signal to be output. If one speech signal frame to be received is not received, then a substitute speech signal frame is used in its place, which is produced as a function of a previously received speech signal frame. According to the invention, in the situation in which the previously received speech signal frame has a voiceless speech signal, the substitute speech signal frame is produced by means of a noise signal.

9 Claims, 5 Drawing Sheets

(56) References Cited

OTHER PUBLICATIONS

Xiaoli, Wang et al. "Reconstruction of Missing Speech Packet Using Trend-Considered Excitation" Singal Processing, 2002 6th International Conference on Aug. 26-30, 2002. vol. 2, pp. 1680-1683. Piscataway, NJ.

Gündüzhan, Emre et al. "A Linear Prediction Based Packet Loss Concealment Algorithm for PCM Coded Speech" IEEE Transactions on Speech and Audio Processing. New York, NY. vol. 9, No. 8, pp. 778-785. Nov. 2001.

* cited by examiner

METHOD FOR ERROR CONCEALMENT IN THE TRANSMISSION OF SPEECH DATA WITH ERRORS

BACKGROUND OF THE INVENTION

The invention relates to a method and an apparatus for dealing with errors in the transmission of speech.

In order to transmit speech signals via cable-based or wire-free networks, it is known for a speech signal to be transmitted on the basis of speech signal frames, wherein, after reception of the speech signal frames, a receiver uses these speech signal frames to produce a speech signal to be output. In this case, the speech signal frames are preferably transmitted as data in the form of so-called packets via networks, for example a GSM network, a network based on the Internet Protocol, or a network based on the WLAN protocol, in which case a speech signal frame may be lost because of data being transmitted with errors. It is likewise possible, when data is transmitted in a packet-switched form, for an excessively long time delay to occur in the transmission of a speech signal frame, as a result of which this speech signal frame cannot be considered in the course of a continuous output of a speech signal, because, for example, the delayed transmitted, or else lost, speech signal frame is not available in order to output the speech signal. If no signals at all are inserted at an appropriate point in the speech signal to be output instead of the speech signal frame which has not been received, then this results in failure of the speech signal to be output at the corresponding point, resulting in degradation of the acoustic quality of the speech signal. For this reason, it is necessary to use a substitute speech signal frame in order to achieve so-called error concealment, instead of a speech signal frame which has not been received.

The fundamental principle for transmission of a speech signal on the basis of speech signal frames and for production of the speech signal on the basis of these speech signal frames is illustrated in FIG. 1. FIG. 1 shows a speech signal 10 which, for example, comprises three segments in the form of speech signal frames 1, 2, 3. In this case, the total of three segments has been chosen only by way of example. To a person skilled in the art, it is self-evident that the number of speech signal frames 1, 2, 3 need not be three. When the speech signal frames 1, 2, 3 are received after transmission, then the speech signal 10 is output continuously at different times. FIG. 1 shows a time axis 20 along which times 31, 32, 33 are shown, at each of which reception of one speech signal frame 1, 2, 3 is completed. According to the exemplary embodiment, the reception of the first speech signal frame 1 is completed at a first time 31, as a result of which the speech signal 10 can be output, as far as a specific part, at the first time 31. According to the exemplary embodiment, the reception of the second speech signal frame 2 is completed at a second time 32, as a result of which a further part of the speech signal 10 can be output at this second time 32. This also applies to a third time 33, at which the third speech signal frame 3 has been completely received.

According to the exemplary embodiment in FIG. 2, production of a further speech signal 11 which is to be output is illustrated. In the exemplary embodiment, the further speech signal 11 is assembled such that the received speech signal frames 1, 2, 3 are not adjacent to one another in time, but overlap. According to the exemplary embodiment in FIG. 2, the further speech signal 11 consists of a first segment 111, a second segment 112 and a third segment 113. As can be seen from FIG. 2, the first segment 111 can be determined by means of the first speech frame 1 and at least a part of the second speech frame 2. The second segment 112 can be determined by means of the second speech frame and at least on the basis of a part of the third speech frame 3. The third segment 113 can be determined on the basis of the third speech frame 3 and on the basis of possibly subsequent further speech frames. A first time 41 is shown on a second time axis 21 that is illustrated in FIG. 2, corresponding to the time at which the first segment 111 of the further speech signal 11 ends. Therefore, in order to allow the further speech signal 11 to be output at the first time 41 at least until the time at which its first segment 111 ends, at least the first speech signal frame 1 and the second speech signal frame 2 must therefore be available. Furthermore, there is a second time 42 on the second time axis 21, which corresponds to the time at which the second segment 112 of the further speech signal 11 ends. Therefore, in order to allow the further speech signal 11 to be output as well at least until the time at which its second segment 112 ends, the second speech signal frame 2 and the third speech signal frame 3 must be available at the second time 42. This also applies to a third time 43 for the third segment 113 of the further speech signal 11 with respect to the third speech signal frame 3 and possibly subsequent speech signal frames. The speech signal frames 1, 2, 3 shown in FIGS. 1 and 2 preferably have respective indices 11, 12, 13 in order to allow the received speech signal frames to be associated with a time sequence.

FIG. 3 shows the situation in which the second speech signal frame 2 has not been received. If the first speech signal frame 1 had actually been received, as shown in FIG. 3, by the first time 41, but not the second speech signal frame 2, it would not be possible to correctly output the further speech signal 11 from FIG. 2 at the first time 41. In addition, although the further speech signal can be produced on the basis of the received third speech signal frame 3 in order to output the further speech signal at the second time 42, the second speech signal frame 2 is still missing, however, at this second time 42. It is therefore necessary to produce a substitute speech signal frame 100 instead of the speech signal frame 2 which has not been received, in order to use this to produce the further speech signal to be output. Appropriate methods for this purpose are already known. The way in which these methods operate is explained in detail in FIG. 4.

FIG. 4 shows steps in a method, with the aid of which a substitute speech signal frame 100 is produced on the basis of a received speech signal frame 50. For this purpose, the received speech signal frame 50 is first of all passed to a linear prediction analysis process 62, which determines linear prediction coefficients 51 for an analysis filter of a linear prediction means 61. The principle of linear prediction and its determination of the linear prediction coefficients for an analysis filter for linear prediction of a speech signal, modeled as a pulse code, of a received speech signal frame 50 is known. The linear prediction analysis filter 61 filters the speech signal of the received speech signal frame 50, thus resulting in the remaining signal 52. This remaining signal 52 is supplied to a decision maker 63, which uses the remaining signal 52 to determine whether the speech signal in the received speech signal frame 50 is a speech signal with or without voice. The decision maker 63 passes on its decision 53 relating to whether the speech signal has or has not got voice to a fundamental frequency determination unit 64. This fundamental frequency determination unit 64 uses the remaining signal 52 and the decision 53 to determine a fundamental frequency 54 of the speech signal. In this case, the fundamental frequency is determined by means of that argument of a normalized autocorrelation function for which the value of the normalized autocorrelation function assumes its maximum.

In this case uses only those values for a fundamental frequency which appear to be worthwhile for human speech signals. In the situation where a speech signal without voice is present, has a noise-like character and therefore does not have a clear fundamental frequency, the fundamental frequency 54 is set to a minimum value, in order to reduce artefacts in the high-frequency range, which result from unnatural periodicities in a signal to be determined.

An estimated remaining signal 55 is determined by means of an estimation unit 65, on the basis of the remaining signal 52 and the fundamental frequency 54. The estimated remaining signal 55 is passed to a linear prediction synthesis filter 66, which uses the previously determined linear prediction coefficients 51 to subject the estimated remaining signal 55 to synthesis filtering, as a result of which the speech signal for the substitute speech signal frame 100 is obtained. In this way, the spectral envelope of the speech signal is extrapolated, while the periodic structure of the signal is maintained at the same time.

As shown in FIG. 4, the substitute speech signal frame 100 is produced on the basis of a received speech signal frame 50. In this case, the received speech signal frame 50 may, for example, be the first speech signal frame 1 in FIG. 3. In the event of short-term interference with the reception and transmission of speech signal frames, all that is necessary according to the prior art is to produce a single speech signal frame. However, if the third speech signal frame 3 from FIG. 3 is also not received, then it is necessary to produce a further substitute speech signal frame. In a situation such as this, a fundamental frequency 54 is used to produce the further substitute speech signal frame, which fundamental frequency 54 is obtained by analysis of that speech signal frame which was obtained before the most recently received first speech signal frame in a time sequence. This results in a variation of the fundamental frequency of the speech signals in the various speech signal frames that are produced, by which means undesirable harmonic artefacts are avoided, which would result if the same speech signal were to be output over an excessively long time period.

For the situation in which a further, third substitute speech signal frame must be produced, the fundamental frequency 54 is once again varied in order to produce the further, third substitute speech signal frame, by obtaining the fundamental frequency 54 on the basis of that speech signal frame which was received two positions before the most recently received, first speech signal frame 1 in the time sequence. In the situation where further substitute speech signal frames must be produced after three substitute speech signal frames have already been determined, the fundamental frequency is not modified any further. Instead of this, all the further substitute speech signal frames are produced by means of that fundamental frequency 54 which was used to produce the third substitute speech signal frame. This fundamental frequency 54 for production of the third substitute speech signal frame is used until the end of the reception interference.

Substitute speech signal frames produced in this way are used instead of the substitute speech signal frames which have not been received. A smooth transition is preferably used for the speech signal frames when producing the speech signal 11 to be output.

SUMMARY OF THE INVENTION

Advantages of the Invention

The method according to the invention, in contrast has the advantage that, in order to estimate a speech signal in a substitute speech signal frame, a better signal quality in the speech signal is achieved in those situations in which the speech signal in the substitute speech signal frame is produced on the basis of a received speech signal frame which has a speech signal without voice. This is achieved in that, when a received speech signal frame has a speech signal without voice, the speech signal of the at least one substitute speech signal frame is produced by means of a noise signal. In this case, noise signals are signals which have no clear fundamental frequency. In this case, a random signal with a uniform distribution within a specific value range is preferably used as a noise signal.

According to a further embodiment of the invention, in the situation in which the at least one previously received speech signal frame has a speech signal with voice, the speech signal of the at least one substitute speech signal frame is produced by means of a fundamental frequency signal. This has the advantage that as a result of the distinction as to whether a speech signal does or does not have voice, and an appropriate use of a noise signal or a fundamental frequency signal to produce the speech signal for the substitute speech signal frame, greater flexibility exists for the production of this speech signal.

According to a further embodiment of the invention, a uniformly distributed noise signal multiplied by a scaling factor is used as the noise signal. This has the advantage that scaling of the noise signal allows the amplitude or the signal energy of the noise signal to be adapted, and thus the amplitude or the energy of the speech signal estimated from this in the substitute speech signal frame to be adapted. This results in the advantage that this adaptation results in a speech signal in a substitute speech signal frame, which is as similar as possible to the speech signal in the previously received speech signal frame.

According to a further embodiment of the invention, the scaling factor is determined as a function of the signal energy in such a filtered speech signal which results from filtering of the speech signal of the previously received speech signal frame by means of a linear prediction filter. This has the advantage that a scaling factor that has been determined in this way is used to produce an estimated noise signal by multiplication by the scaling factor, the signal energy of which noise signal is as similar as possible to the signal energy of the speech signal which was previously obtained by linear prediction, specifically because the estimated measurement signal is subsequently filtered again by a linear synthesis filter with linear prediction coefficients of the previous analysis filter, in order to obtain the signal for the substitute speech signal frame.

According to a further embodiment of the invention, after filtering by an analysis filter, for linear prediction, the filtered speech signal is subdivided into respective partial frames and respective speech signal frames, wherein the respective signal energy of the partial speech signal is determined for each partial frame. The scaling factor is determined as a function of that signal energy which has the lowest value of the respective signal energies. This results in scaling factors, and therefore estimated remaining signals, which lead to speech signals for a substitute speech signal frame, which results in a high perceptive quality from the acoustic point of view for a listener, for the production of the speech signal to be output.

According to a further embodiment of the invention, a decision is made as to whether a previously received speech signal frame has a speech signal with or without voice, as a function of a normalized autocorrelation function of the speech signal of the received speech signal frame and as a function of a zero crossing rate of the speech signal of the received speech signal frame. This has the advantage that such linking of a normalized autocorrelation function and a zero crossing rate makes it possible to make a more reliable decision than in the prior art as to whether the speech signal does or does not have voice.

According to another independent claim, a controller is claimed for outputting a speech signal. The controller has a first interface via which the controller receives speech signal frames. Furthermore, the controller has a computation unit, which uses the received speech signal frames in a predetermined sequence to produce the speech signal to be output. The controller according to the invention uses a second interface to output the speech signal to be output. In the situation when at least one speech signal frame to be received has not been received, the computation unit uses a substitute speech signal frame instead of the at least one speech signal frame which has not been received, with the computation unit producing the substitute speech signal frame as a function of at least one previously received speech signal frame. The controller according to the invention is characterized in that, in the situation in which the previously received speech signal frame has a speech signal without voice, the computation unit produces the speech signal of the one substitute speech signal frame by means of a noise signal. This has the advantage that the use of a noise signal to produce the speech signal for the substitute speech signal frame results in better perceptive quality from the acoustic point of view for a listener than in the case of methods according to the prior art, in which a fundamental frequency signal is always used to produce the substitute speech signal frame.

According to another independent claim, a controller is claimed in which in the situation in which the previously received speech signal frame has a speech signal with voice, the computation unit produces the speech signal of the substitute speech signal frame by means of a fundamental frequency signal. This has the advantage that the use of the fundamental frequency signal or of a noise signal to produce the speech signal for the substitute speech signal frame correspondingly makes it possible to produce a speech signal in which it is possible to correspond to the speech signal, with or without voice, in the previously received speech signal frame.

According to a further independent claim, a controller is claimed which furthermore has a memory unit, which provides the noise signal and/or the fundamental frequency signal. This has the advantage that the noise signal and/or the fundamental frequency signal need not itself be produced by the computation unit, for example by a shift register, but that these signals can be called up in a simple manner from the memory unit.

BRIEF DESCRIPTION OF THE DRAWINGS

Exemplary embodiments of the invention are illustrated in the drawing and will be explained in more detail in the following description.

Furthermore.

DETAILED DESCRIPTION

Figure 1:
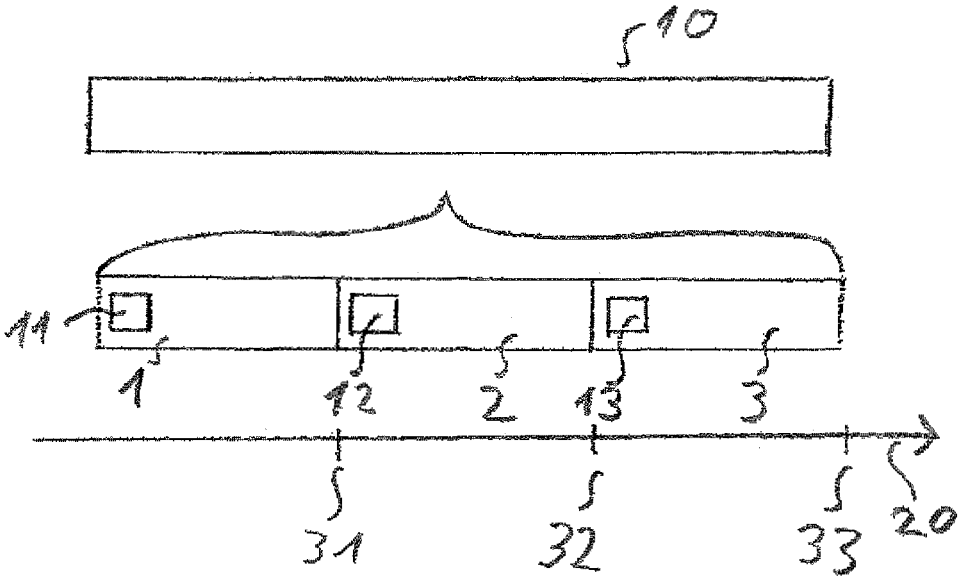
FIG. 1 shows a diagram of a speech signal and speech signal frames.
Figure 2:
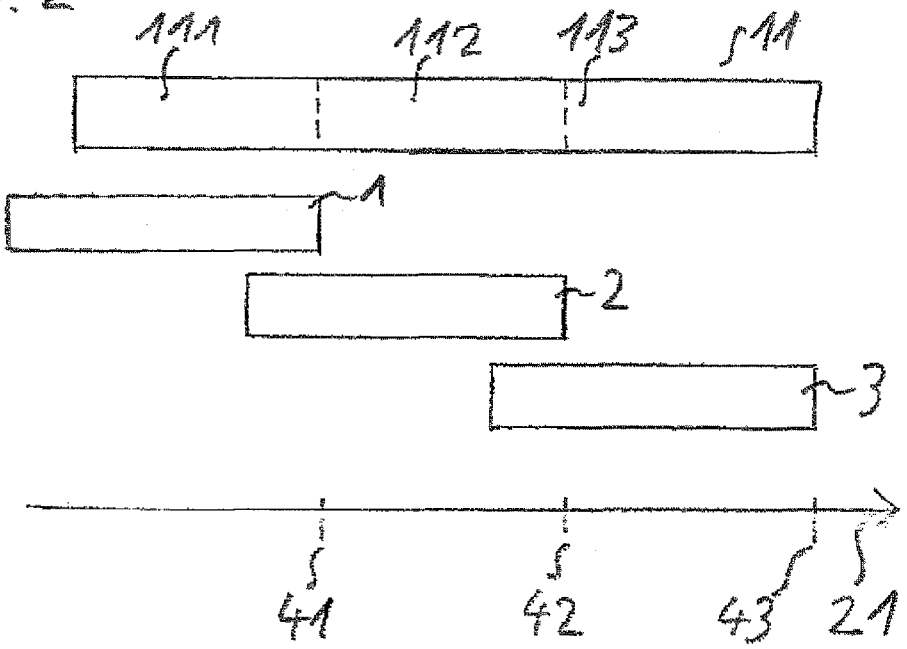
FIG. 2 shows a diagram of a speech signal produced from the speech signal frames of FIG. 1.
Figure 3:
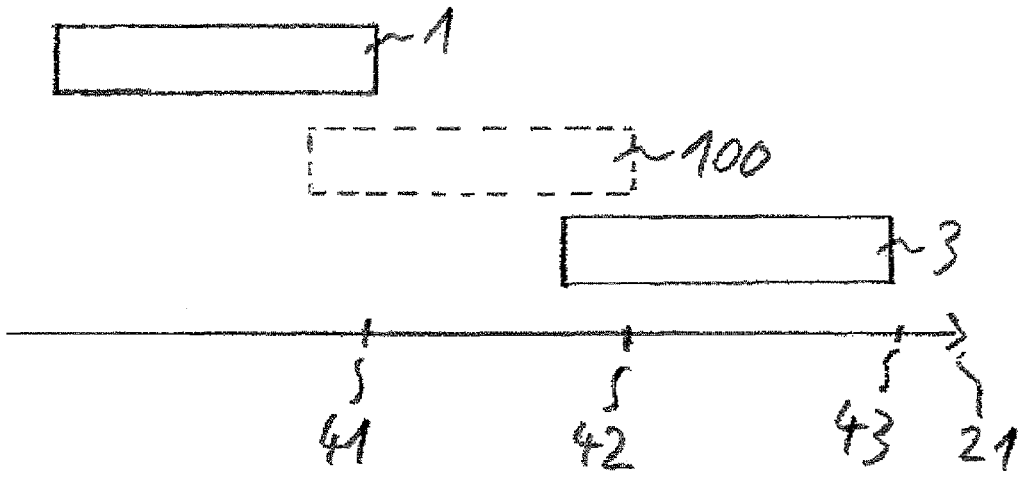
FIG. 3 shows a diagram of speech signal frames where one speech signal frame is not receive.
Figure 4:
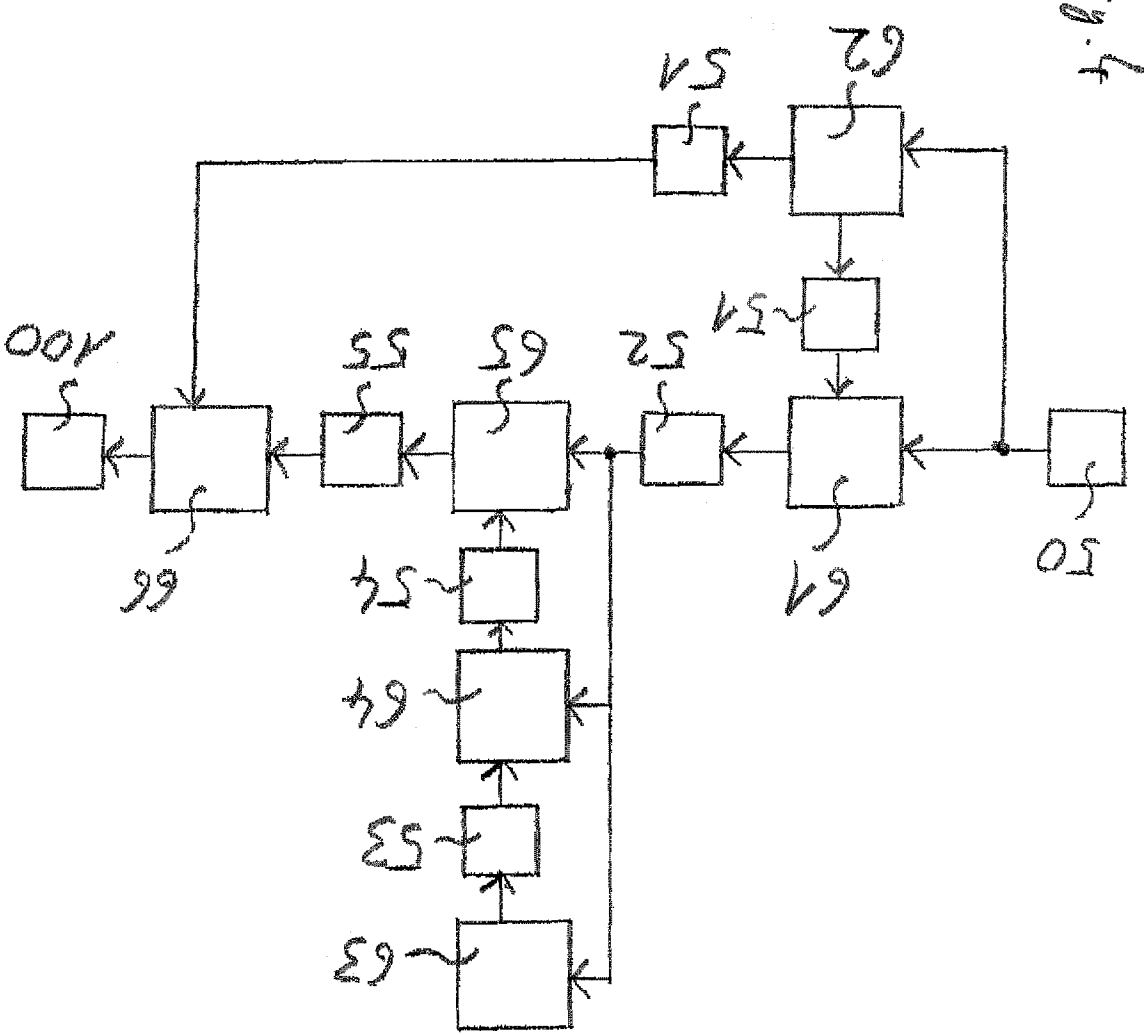
FIG. 4 shows a prior art method for substituting a speech signal frame for a speech signal frame that is not received.
Figure 5:
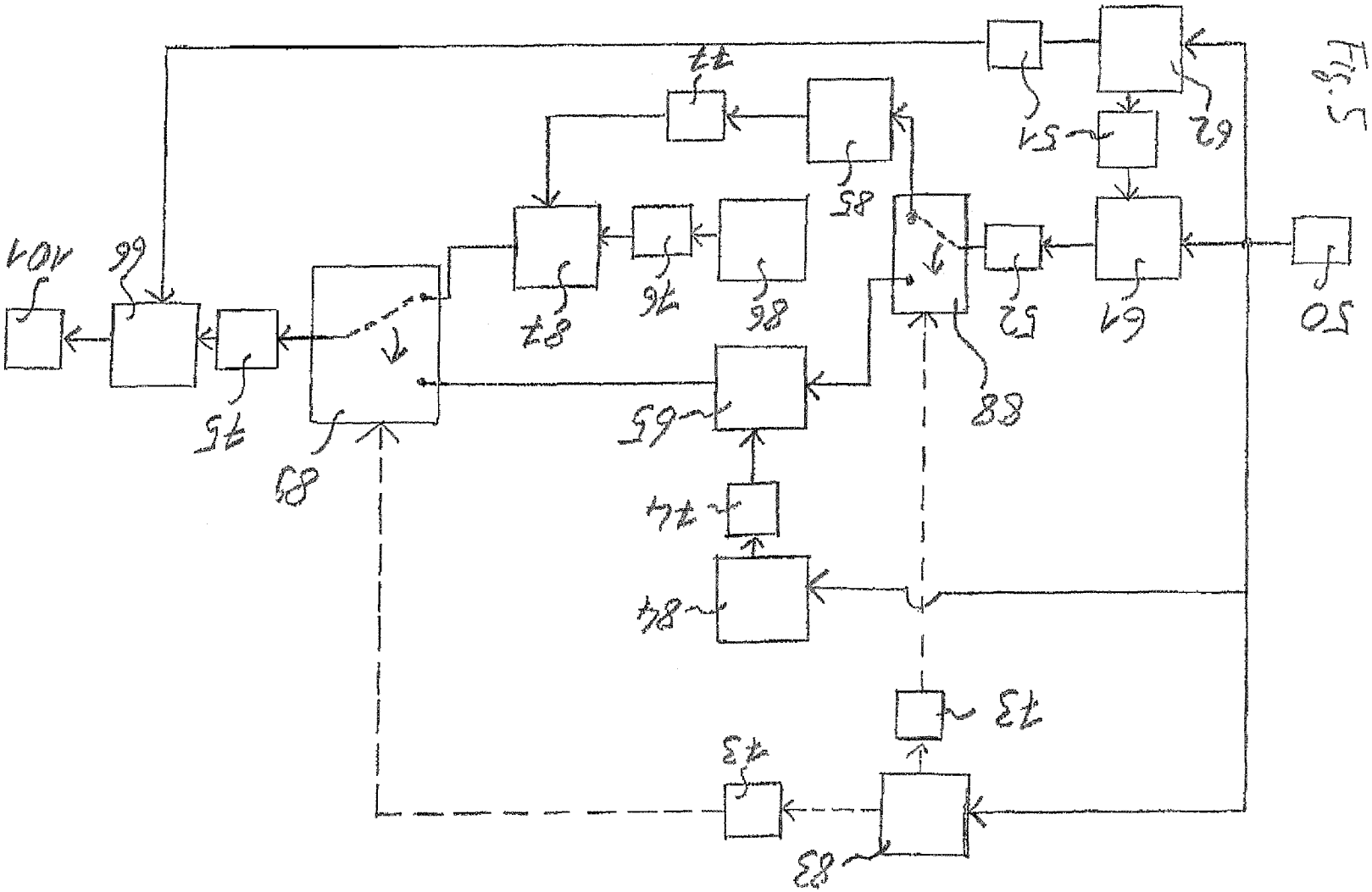
FIG. 5 shows one exemplary embodiment of a method according to the invention.

FIG. 5 shows one preferred embodiment of the method according to the invention. The speech signal in a previously received speech signal frame 50 is passed to a unit in order to determine linear prediction coefficients by means of a linear prediction analysis means 62, by which means linear prediction coefficients 51 are obtained. The analysis filter for the linear prediction means 61 produces the remaining signal 52 by means of the linear prediction coefficients 51 and the speech signal in the received speech signal frame 50. A modified decision unit 83 for deciding whether the speech signal does or does not have voice does not make this decision on the basis of the remaining signal 52, as is taught according to the prior art, but on the basis of the speech signal in the received speech signal frame 50. Furthermore, a modified fundamental frequency 74 is obtained as a function of the speech signal in the received speech signal frame 50, by means of a modified fundamental frequency determination unit 84, which is known from the document. First switching of the remaining signal 52 either takes place to a production unit 65, which produces a modified estimated remaining signal 75 on the basis of the remaining signal 52 and the modified fundamental frequency 74, or the remaining signal 52 is switched to an energy calculation unit 85, depending on the modified decision 73 by the modified decision unit 83 as to whether the signal does or does not have voice. If the modified decision 73 was that the speech signal in the received speech signal frame 50 was identified not to have voice, then the switching is carried out such that the remaining signal is switched to the energy calculation unit 85. If it is decided that the signal does have voice, the switching takes place such that the remaining signal 52 is switched to the production unit 65. The production unit 65 now uses the modified fundamental frequency 74 and the remaining signal 52 to produce the modified estimated remaining signal 75, in which case the way in which this is produced on the basis of a fundamental frequency and a remaining signal is known. In the case of a signal without voice, the energy calculation unit 85 uses the remaining signal 52 to calculate a gain factor 77, which is multiplied in a multiplication unit 87 by a noise signal 76 which is produced by a noise generator 86. This multiplication results in the modified estimated noise signal 75 being produced when a decision is made that the signal in the received speech signal frame 50 does not have voice.

A second switching unit 89 is likewise switched as a function of the modified decision 73 in order to tap off the modified estimated remaining signal 75, such that either the remaining signal produced by a modified fundamental frequency or the remaining signal produced by a noise signal is tapped off depending on whether the speech signal in the received speech signal frame 50 does or does not have voice. This modified estimated remaining signal 75 is passed to a synthesis filter for linear prediction, which uses the linear prediction coefficients 51 obtained for synthesis. The speech signal for the substitute speech signal frame 100 is therefore produced at the output of the synthesis filter of the linear prediction means 66.

The decision as to whether the speech signal in the received speech signal frame 50 does or does not have voice is preferably made in the modified decision unit 83 as a function of a normalized autocorrelation function of the speech signal and of a zero crossing rate of the speech signal. For a preferably digital speech signal x(n) of length N, with the index n=0, . . . , N−1 and a previously determined period length $P_0$ of a fundamental frequency, the normalized autocorrelation function ζ(x(n)) is preferably determined using the calculation rule:

$$\zeta(x(n)) = \frac{\sum_{n=0}^{N-1} x(n)x(n-P_0)}{\sum_{n=0}^{N-1} x^2(n) \sum_{n=0}^{N-1} x^2(n-P_0)}.$$

Furthermore, the zero crossing rate zcr(x(n)) for the speech signal x(n) is preferably determined by means of the calculation rule:

$$zcr(x(n)) = \frac{1}{2N} \sum_{n=1}^{N-1} |\text{sign}\{x(n)\} - \text{sign}\{x(n-1)\}|,$$

where the expression SIGN represents the sign function, that is to say the mathematical sign function. According to the embodiment of the invention, a decision is then made that the signal x(n) has voice when firstly, the normalized autocorrelation function ζ(x(n)) exceeds a first threshold value $thr_1$ $$\zeta(x(n)) > thr_1$$

and when, furthermore, and secondly, the zero crossing rate zcr(x(n)) undershoots a second threshold value $thr_2$ $$zcr(x(n)) < thr_2.$$

The first threshold value $thr_1$ is preferably chosen to be the value 0.5. A person skilled in the art would choose the second threshold value $thr_2$ from analysis of empirical data of zero crossing rates zcr(x(n)) of speech signals with and without voice.

Figure 6:
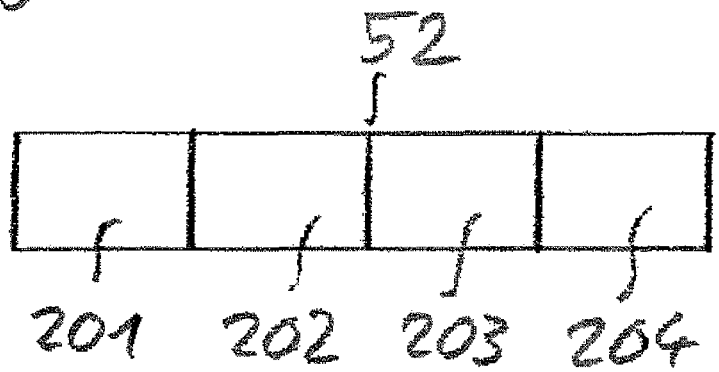
FIG. 6 shows a speech signal frame which is subdivided into partial frames.

According to a further embodiment of the invention, a uniformly distributed noise signal is used as the noise signal 76, with the modified estimated remaining signal being obtained by multiplication of the noise signal by a scaling factor or a gain factor 77. The scaling factor 77 is in this case preferably determined as a function of the signal energy in the filtered speech signal 52. According to one particular embodiment in this case, as shown in FIG. 6, the filtered speech signal 52 of the received and filtered speech signal frame is subdivided into respective partial frames 201 to 204 with respective partial speech signals. The subdivision into four different partial frames 201 to 204 as shown in FIG. 6 is in this case only an example. It is likewise possible to subdivide it into a number of partial frames other than four. According to the exemplary embodiment, the four partial frames have indices i=1, . . . , 4. If the filtered signal e(n) with the filtered speech signal 52 has the length N, then, according to the exemplary embodiment, a respective partial speech signal $e_i(n)$ of length $N_{SF}$ is obtained for each partial frame 201 to 204, which length, according to the exemplary embodiment, corresponds to $N_{SF}$=N/4. The signal energy for each of the partial frames or partial speech signals $e_i(n)$ is determined using the calculation rule:

$$E_i = \frac{1}{N_{SF}} \sum_{n=0}^{N_{SF}-1} e^2((i-1)N_{SF}+n)$$

If the minimum E=min{$E_1$,$E_2$,$E_3$,$E_4$} of the signal energies that are present in the partial frames 201 to 204 is now determined in accordance with the exemplary embodiment, the noise signal 76 r(n) is preferably scaled such that $\sqrt{E}$ is chosen as the scaling factor or gain factor 77. The estimated remaining signal 75 when the speech signal in the received speech signal frame 50 does not have voice is therefore preferably determined to be: $\hat{r}(n)=\sqrt{E}\cdot r(n)$.

Figure 7:
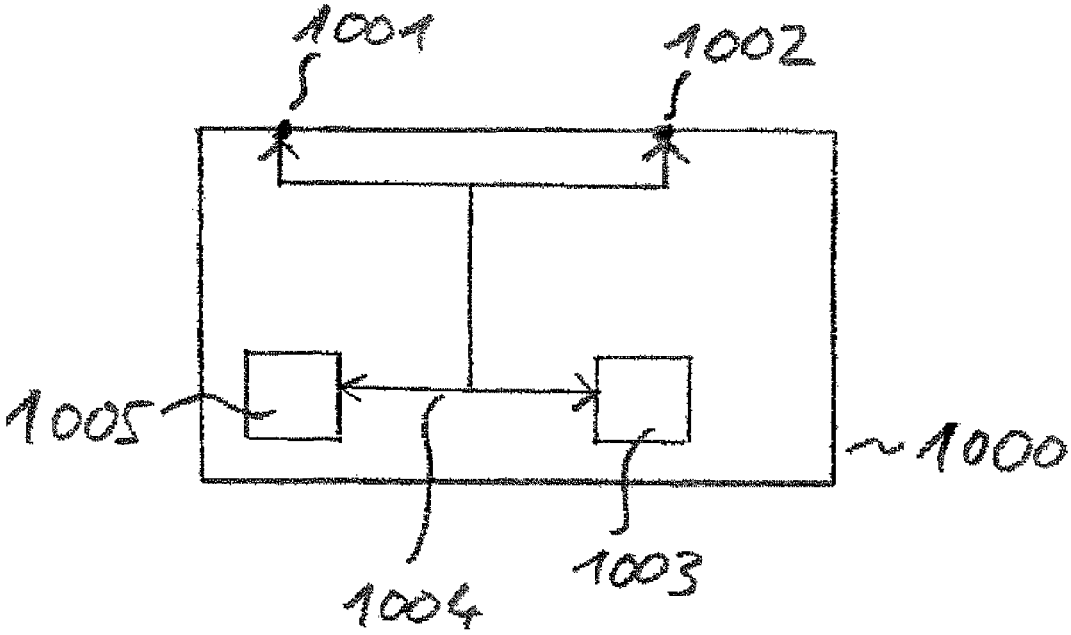
FIG. 7 shows one embodiment of a controller according to the invention.

FIG. 7 shows a controller 1000 according to the invention. This controller 1000 has a first interface 1001 for reception of speech signal frames. A computation unit 1003 in the controller 1000 uses the received speech signal frames in a predetermined sequence to produce the speech signal to be output, which is output via a second interface 1002 of the controller 1000. The computation unit 1003, the first interface 1001 and the second interface 1002 are preferably connected to one another via a bus system 1004 or a similar apparatus for interchanging data and/or signals. In the situation in which a speech signal frame to be received is not received, the computation unit uses a substitute speech signal frame instead of the speech signal frame which has not been received. For this purpose, the computation unit produces the substitute speech signal frame as a function of a previously received speech signal frame. The controller according to the invention is characterized in that in the situation in which the previously received speech signal frame has a speech signal without voice, the computation unit 1003 produces the speech signal of the substitute speech signal frame by means of a noise signal.

In the situation in which the previously received speech signal frame has a speech signal with voice, the computation unit 1003 preferably produces the speech signal of the substitute speech signal frame by means of a fundamental frequency signal.

This controller 1000 preferably has a memory unit 1005, which provides a fundamental frequency signal and/or a noise signal.

The invention claimed is:

1. A method for outputting a speech signal (11), wherein speech signal frames (1, 3) are received by a controller and are used in a predetermined sequence to produce the speech signal (11) to be output, wherein, in the situation in which at least one speech signal frame (2) to be received is not received, at least one substitute speech signal frame (100) is used instead of the at least one speech signal frame (2) which has not been received, wherein the at least one substitute speech signal frame (100) is produced by the controller as a function of at least one previously received speech signal frame (1), characterized in that, in the situation in which the at least one previously received speech signal frame (1) has a speech signal without voice, the at least one received speech signal frame (1) is filtered by means of a linear prediction filter, the speech signal of the at least one substitute speech signal frame (100) is produced by the controller by means of a noise signal (75) generated from a uniformly distributed noise signal (76) multiplied by a scaling factor (77) determined as a function of the signal energy in the filtered speech signal (52); wherein the filtered speech signal (52) is subdivided into respective partial frames with respective partial speech signals, in that the respective signal energy is determined for each partial speech signal, and in that the scaling factor (77) is determined as a function of that signal energy which has the lowest value of the respective signal energies.

2. The method as claimed in claim 1, characterized in that, in the situation in which the at least one previously received speech signal frame (1) has a speech signal with voice, the speech signal of the at least one substitute speech signal frame (100) is produced by means of a fundamental frequency signal.

3. The method as claimed in claim 2, characterized in that a decision is made as to whether the previously received at least one speech signal frame (1) has a speech signal with or without voice, as a function of a normalized autocorrelation function and a zero crossing rate of the speech signal of the previously received at least one speech signal frame (1).

4. The method as claimed in claim 3, characterized in that the speech signal of the at least one previously received speech signal frame (1) is decided to have voice when the normalized autocorrelation function exceeds a first predetermined threshold value and when the zero crossing rate does not exceed a second predetermined threshold value.

5. A controller (1000) for outputting a speech signal, having a first interface (1001) via which the controller (1000) receives speech signal frames, having a computation unit (1003), which uses the received speech signal frames in a predetermined sequence to produce the speech signal to be output, having a second interface (1002), via which the controller (1000) outputs the speech signal, wherein, in the situation in which at least one speech signal frame to be received is not received, the computation unit (1003) uses at least one substitute speech signal frame instead of the at least one speech signal frame which has not been received, wherein the computation unit (1003) produces the at least one substitute speech signal frame as a function of at least one previously received speech signal frame, characterized in that, in the situation in which the at least one previously received speech signal frame has a speech signal without voice, the computation unit (1003) produces the speech signal of the at least one substitute speech signal frame filtered by means of a linear prediction filter by means of a noise signal (75) generated from a uniformly distributed noise signal (76) multiplied by a scaling factor (77) determined as a function of the signal energy in the filtered speech signal (52); wherein the filtered speech signal (52) is subdivided into respective partial frames with respective partial speech signals, in that the respective signal energy is determined for each partial speech signal, and in that the scaling factor (77) is determined as a function of that signal energy which has the lowest value of the respective signal energies.

6. The controller as claimed in claim 5, characterized in that, in the situation in which the at least one previously received speech signal frame has a speech signal with voice, the computation unit (1003) produces the speech signal of the at least one substitute speech signal frame by means of a fundamental frequency signal.

7. The controller as claimed in claim 5, characterized in that the controller (1000) has a memory unit (1005), which provides the noise signal and/or the fundamental frequency signal.

8. The controller as claimed in claim 5, characterized in that the controller (1000) has a memory unit (1005), which provides the noise signal.

9. The controller as claimed in claim 5, characterized in that the controller (1000) has a memory unit (1005), which provides the fundamental frequency signal.

* * * * *

UNITED STATES PATENT AND TRADEMARK OFFICE

CERTIFICATE OF CORRECTION

PATENT NO. : 8,612,218 B2
APPLICATION NO. : 13/121820
DATED : December 17, 2013
INVENTOR(S) : Vary et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 332 days.

Signed and Sealed this
Twenty-second Day of September, 2015

Michelle K. Lee

Michelle K. Lee
*Director of the United States Patent and Trademark Office*